US006193094B1

(12) United States Patent
Diamond et al.

(10) Patent No.: US 6,193,094 B1
(45) Date of Patent: Feb. 27, 2001

(54) RESEALABLE EASY OPEN CLOSURE AND CAN

(75) Inventors: George B. Diamond, 62 Anthony Rd., Glen Gardner, NJ (US) 08826; Ralph Helmrich, Asbury, NJ (US)

(73) Assignee: George B. Diamond, Glen Gardner, NJ (US)

( * ) Notice: Subject to any disclaimer, the term of this patent is extended or adjusted under 35 U.S.C. 154(b) by 0 days.

(21) Appl. No.: 09/227,049

(22) Filed: Jan. 7, 1999

Related U.S. Application Data

(60) Provisional application No. 60/070,660, filed on Jan. 7, 1998.

(51) Int. Cl.[7] ..... B65D 39/02

(52) U.S. Cl. ..... 220/254; 220/359.2

(58) Field of Search ..... 220/254, 359.1, 220/359.2, 359.4, 270, 618, 620, 789, 790, 791, 801, 802, 803

(56) References Cited

U.S. PATENT DOCUMENTS

| | | | | |
|---|---|---|---|---|
| 2,767,754 | * | 10/1956 | Lederer et al. | 220/270 |
| 2,998,158 | | 8/1961 | Tupper . | |
| 3,356,250 | | 12/1967 | Russell . | |
| 3,557,998 | | 1/1971 | Collie . | |
| 3,749,276 | * | 7/1973 | Davis | 220/790 |
| 3,998,354 | | 12/1976 | Song . | |
| 4,165,016 | | 8/1979 | Moller . | |
| 4,266,689 | * | 5/1981 | Asher | 220/790 |
| 4,318,494 | | 3/1982 | Heyn . | |
| 4,385,708 | | 5/1983 | Curry . | |
| 4,407,424 | | 10/1983 | Heyn . | |
| 4,427,128 | | 1/1984 | Heyn . | |
| 4,433,793 | | 2/1984 | Ingemann . | |
| 4,434,907 | | 3/1984 | Ingemann . | |
| 4,440,310 | | 4/1984 | Heyn . | |
| 4,467,938 | | 8/1984 | Allen . | |
| 4,473,168 | | 9/1984 | Cox . | |
| 4,529,100 | | 7/1985 | Ingemann . | |
| 4,544,080 | * | 10/1985 | Wright et al. | 220/270 X |
| 4,620,642 | * | 11/1986 | Wertz et al. | 220/791 |
| 4,660,735 | | 4/1987 | Peschardt et al. . | |
| 4,682,706 | | 7/1987 | DeVore et al. . | |
| 4,699,290 | | 10/1987 | Adams . | |
| 4,724,978 | | 2/1988 | Cleevely et al. . | |
| 4,724,979 | | 2/1988 | Cleevely et al. . | |
| 4,741,450 | | 5/1988 | Braude . | |
| 4,911,323 | | 3/1990 | Arfert et al. . | |
| 4,981,229 | * | 1/1991 | Lanham | 220/270 X |
| 5,020,686 | | 6/1991 | Dutt . | |
| 5,042,680 | | 8/1991 | Argudo et al. . | |
| 5,050,763 | | 9/1991 | Christensson . | |
| 5,054,642 | * | 10/1991 | Yoshida | 220/270 X |
| 5,085,339 | | 2/1992 | Roth et al. . | |
| 5,125,528 | | 6/1992 | Heyn et al. . | |
| 5,145,085 | | 9/1992 | Yost . | |
| 5,273,416 | | 12/1993 | Heyn et al. . | |
| 5,360,588 | | 11/1994 | Heyn et al. . | |
| 5,398,908 | * | 3/1995 | Kienle | 220/790 |
| 5,511,679 | | 4/1996 | Beck . | |
| 5,617,968 | | 4/1997 | Luburic . | |
| 5,758,793 | | 6/1998 | Forsyth et al. . | |

* cited by examiner

*Primary Examiner*—Nathan J. Newhouse
(74) *Attorney, Agent, or Firm*—Ostrolenk, Faber, Gerb & Soffen, LLP

(57) ABSTRACT

A can shaped at the top to cooperate with a resealable easy open closure or end so that the end can be peeled away to open a can and the easy open end can be snapped back in to close the can.

24 Claims, 9 Drawing Sheets

RESEALABLE EASY OPEN CLOSURE AND CAN

RELATED APPLICATIONS

This application is based on Provisional Application Ser. No. 60/070,660 entitled "RESEALABLE EASY OPEN END FOR CANS", filed Jan. 7, 1998.

BACKGROUND OF THE INVENTION

This invention relates to a resealable easy open closure or end for containers such as cans, jars, bottles and the like.

Easy open ends ("EOE") are can ends (tops) which have a score line or similar weakening segment which weakens the end against a tearing type force but maintain a strength against a vacuum and/or a pressure type force. A pull tab is part of the end and by pulling on the tab the segment of the end which is inside the score line tears off, thus opening the can without the use of a can opener.

In the case of an adhesively sealed EOE, the entire EOE is removed. In the case of drinks (soft drinks, beer, non-carbonated drinks, juices and similar products) only a small section of the end is torn off (or sometimes pushed in and left on inside the can or lifted and left on the outside of the can).

In the case of soups, meats, etc., most of the end is torn off leaving a small segment which is outside the score line (i.e. towards the can wall). If heat or adhesively sealed, no score line is necessary and the entire segment is removed, although a heat or adhesive seal with a score line can also be used.

In the case of an easy open end that is used for sterilized foods such as meat, fish, soups, vegetables, fruits, etc., the part that is torn off is at present usually discarded and no provision for a reseal is generally made—the cans generally being of such size that they are single-use cans or, if multi-use cans, the contents are either transferred to a different closeable container (such as a freezer or refrigerator sealable container) or the top of the opened can is wrapped with foil or plastic.

In those cases not requiring sterilization of the contents, such as dry foods, nuts coffee, candy, crisps (potato or other chips), pretzels and other snack foods, and in the case of bird seed or even sporting goods (e.g. tennis balls) and industrial products (e.g. chemicals or small parts), if an easy open end (which in these cases can also be a membrane (scored or unscored) glued or heat sealed to the container) is provided, a separate plastic snap-on cover is usually also provided. the container itself can be metal, plastic or composite (paper-foil-plastic). Generally, membranes are not used where the products are under substantial pressure or vacuum.

In the case of easy open ends for beverages (soft drinks, beer and non-carbonated beverages), which ends have a small section which is scored or attached with adhesive, the loss of carbonation and/or the sanitary requirements make it difficult to store these products even for a short time, and therefore a screw or bayonet type resealable cap is provided, and this requires two hands to reseal.

Since a resealable easy open end is very useful and desirable, the prior art shows many patents dealing with resealable easy open ends. These patents have common factors, namely, that there is a frame member attached to the can and to which the resealable easy open end is attached. Additionally, these patents may or may not have a tear strip which is attached to the frame member, and may or may not have a part of the end remaining on the can. In all of these cases, there is a plurality of pieces which have to be used to achieve the required function. This group includes U.S. Pat. Nos. 5,758,793, 5,617,968, 5,511,679, 5,125,528, 5,085,339, 5,050,763, 5,042,680, 5,020,686, 4,724,979, 4,724,978, 4,699,290, 4,682,706, 4,660,735, 4,529,100 and 3,557,998.

The partly open end makes it difficult to remove the contents, and the plastic ring to which the end is sealed makes it much more expensive, i.e., two parts instead of one part. The end is also awkward to reseal since two hands have to be used, one to force it over the button and the other to hold the can against this force.

These ends are expensive since either a frame member has to be molded in addition to the removable section or a separate closing cap has to be provided. In addition to the cost which can represent a factor of as much as 20%–80% if not more of the cost of the can, these ends are environmentally unfriendly because either a plastic throw away overcap or an injection molded frame member are needed.

In some cases a hinged flap is also required and part of the lid stays on the can even if it is not a separate member, or a tear strip is required. This group includes U.S. Pat. Nos. 5,145,085, 5,085,339, 5,050,763, 4,741,450, 4,724,979, 4,724,978, 4,699,290, 4,473,168, 4,434,907, 4,433,793, 4,427,128, 4,385,708, 4,165,016, 3,998,354, 3,557,998, 3,356,250 and 2,998,158.

In all of the above patents there is at least one or a combination of a separate frame member that stays on the can, a hinged cover, a part of the cover that stays on the can, a tear strip, a weakening member combined with one of the above, a plurality of pieces, pieces that have to be injection molded (i.e. they cannot be cut from a sheet), weakened members, separate membranes (i.e. two-part ends), or they require double seaming. None of the above patents show a simple, one piece, easily manufactured resealable easy open end.

SUMMARY OF THE INVENTION

It is an object of the present invention to provide a less expensive and more environmentally sound resealable easy open closure or end and can.

The present invention is directed to a resealable easy open end that is one piece (with an integral or attached pull tab) that is completely and fully removable, uses a minimum amount of material in order to be environmentally friendly, can be resealed with one hand, and can be manufactured very inexpensively.

Instead of having to use a separate frame member, we make the container with a very small inwardly-facing recess and a flat section so that the resealable easy open end is attached to the flat section and slides into the recess, and the very small recess allows the end to slide in and to be pulled away from the attachment point using the flexibility of the end to bypass the recess, and again uses the flexibility of the end to snap the end back in. The end and the container cooperate to allow the required function. In another embodiment, we make the container with an inwardly-facing ledge and an outwardly-facing flat section.

The identical system can be used for a resealable easy open end for beverage cans and can be part of the seamed-on top, or part of an integral top and seamed-on bottom. For this purpose, we can make our resealable easy open end into a beverage-type easy open end, this is a partially opening easy open end as opposed to a totally openable easy open end, by making the recess and flat section in one of the can ends instead of in the can wall. In this case, if the beverage is carbonated, the pressure of the carbon dioxide will help to seal the system against loss of the carbon dioxide, and make the can reusable after it is partly used. If the beverage is not carbonated, this resealed end will keep it sanitary by virtue of its snap-in fit.

The recess and flat sections can be either above or below the plane of the end.

For carbonated beverages, or hot-fill or sterilized beverages, or hot-fill or sterilized foods, the tab and sealing segment are so located that the vacuum or pressure in the can do not break the seal, but a peeling force used to pull the tab does break the seal. The resealable easy open end is shaped and is made of such resiliency as to cooperate with the peeling force and to oppose the vacuum or pressure force. It is well-known that a peeling force can break a seal but a vacuum or pressure force cannot if the sealing area and sealing method and the pull tab are properly located.

In all cases, the seal between the resealable easy open end and the container can be made by any of several known methods such as using an adhesive, using heat, using sonic heating, using high-frequency heating or heating the container (if it is metallic) by electrical induction or locally by direct heat application.

The resealable easy open end can be made from various plastics, composite plastics, plastic and metal foil composites with or without vapor and oxygen barriers, or even from metal of the required springiness.

Other features and advantages of the present invention will become apparent from the following description of the invention which refers to the accompanying drawings.

BRIEF DESCRIPTION OF THE DRAWINGS

FIG. 4B showing the tab in a position to be pulled; FIG. 4C showing the tab pulled and the seal starting to peel away; and FIG. 4D showing the easy open end in position to be pushed into a snapped-in position.

DETAILED DESCRIPTION OF EMBODIMENTS OF THE INVENTION

Figure 1:
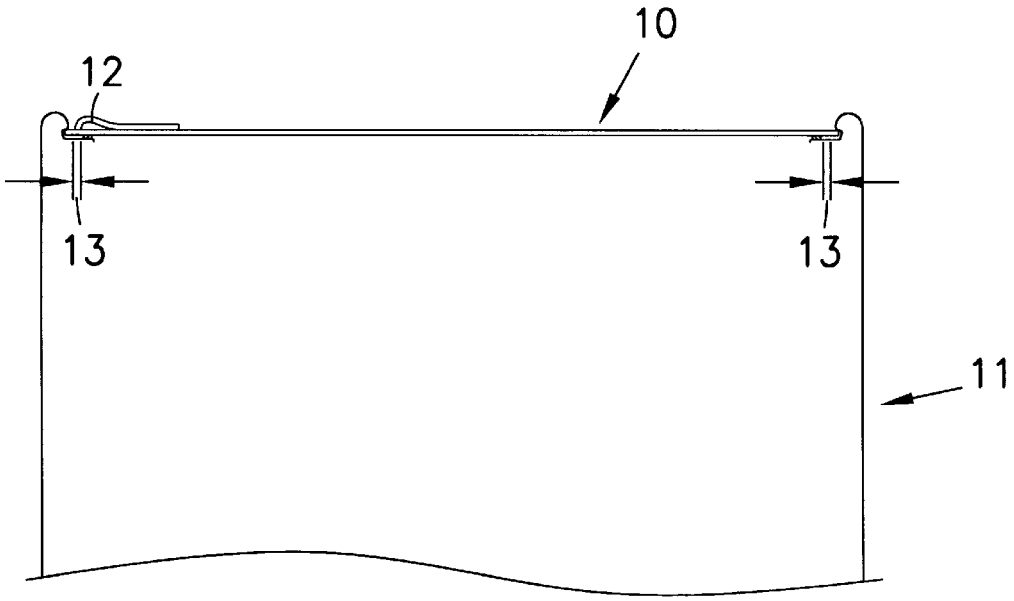
FIGS. 1 and 2 show a side view and a top view, respectively, of a can and a sealed-on resealable easy open end in accordance with the invention.
Figure 2:
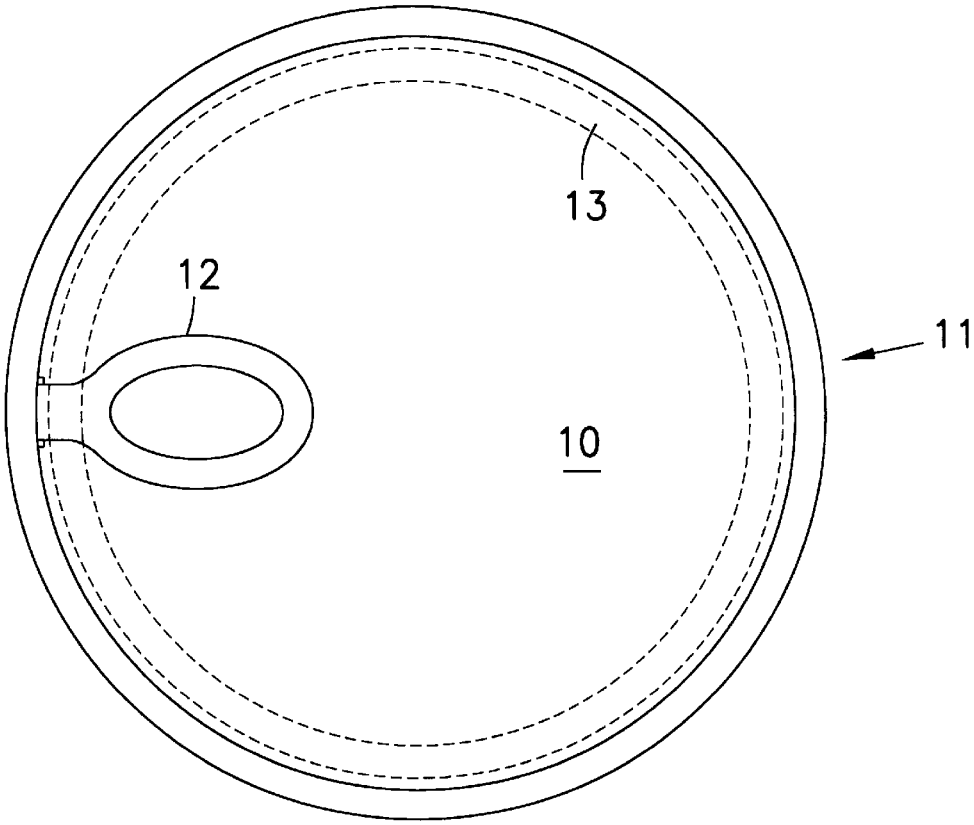

Referring now to the drawings, and in particular to FIGS. 1 and 2, there is shown a side view and a top view of a resealable easy open end 10 sealed to a can 11 in accordance with the present invention. The end 10 has a pull tab 12 attached thereto and is sealed to the can 11 in a seal area 13 inward of the can wall.

Figure 3A:
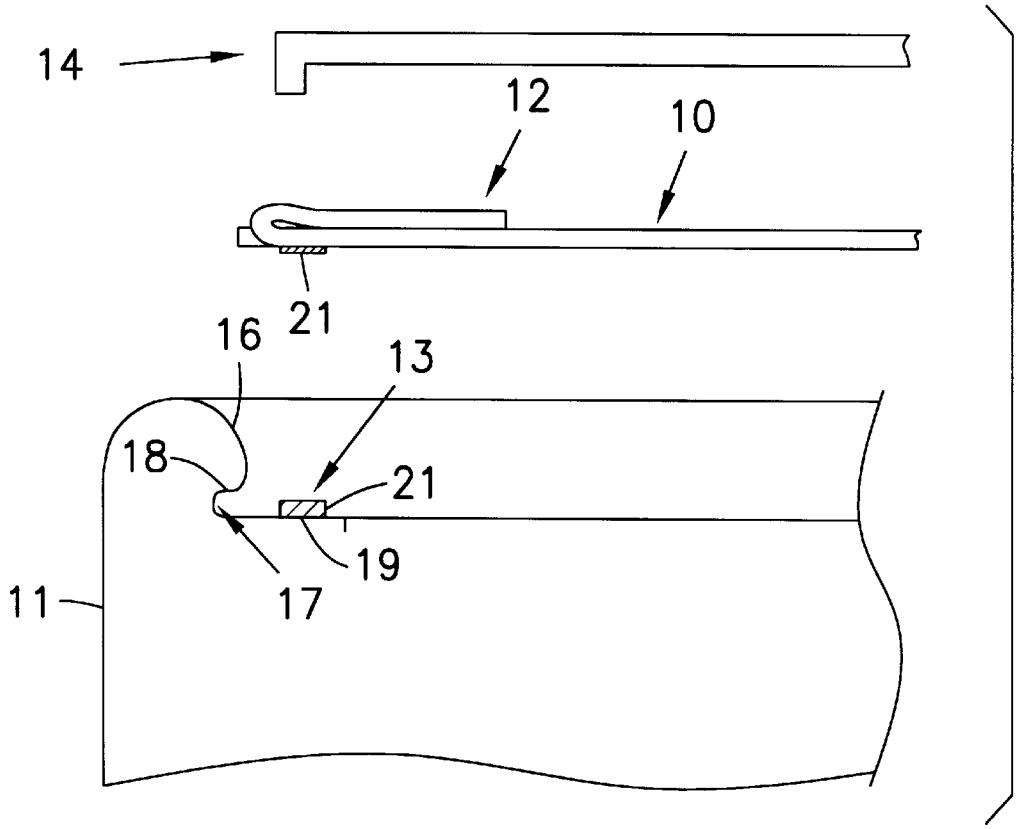
FIG. 3A is an exploded view showing a pull tab, easy open end, sealing area and internal curl of the can and easy open end of FIGS. 1 and 2 along with a sealing head used to seal the easy open end.

FIG. 3A is an exploded view showing the easy open end 10 prior to being sealed to the can 11 in the seal area 13 by means of a sealing head 14.

The can 11 has a curled inner portion 16 with a recess 17 or indentation which forms upper and lower ledges 18 and 19, respectively. The lower ledge 19 may have a sealing adhesive 21 affixed thereto in the sealing area 13 to seal with a sealing adhesive 22 affixed to the underside of the easy open end 10 in an area inward of the periphery thereof.

Figure 3B:
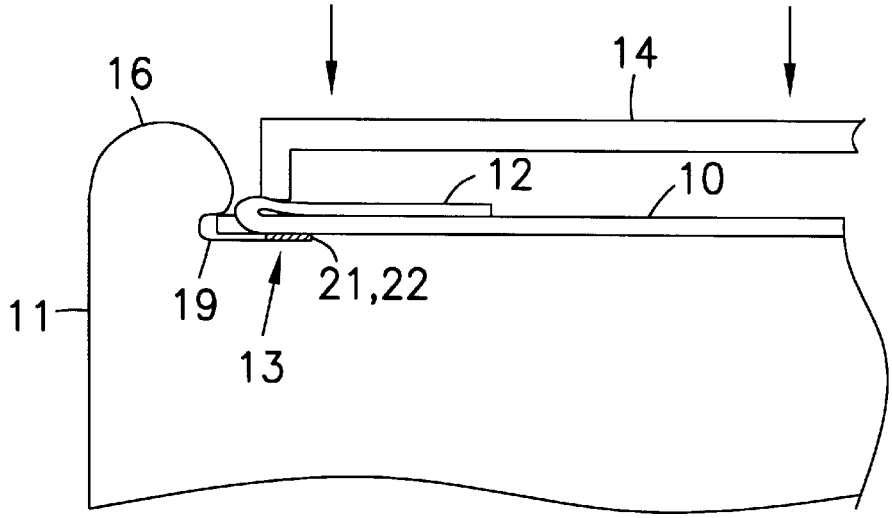
FIG. 3B shows the sealing head in its down position.

To seal the easy open end 10 to the can 11, the sealing head 14 is moved downwardly (FIG. 3B) snapping the peripheral portion of the easy open end 10 into the recess 17. Heat or another sealing energy, such as infrared, is then applied to activate the sealing adhesives 21 and 22 and seal the easy open end 10 to the lower ledge 19. If no adhesive is used then heat in various forms is used to partly melt the plastic for adhesion.

It should be noted that the pull tab 12 must be located sufficiently inwardly of the innermost part of the curled portion 16 so that the pull tab 12 and curled portion 16 do not interfere with one another as the easy open end 10 is being snapped into the recess.

The easy open end 10 is made of a thin flexible material. Accordingly, even though the periphery of the easy open end 10 extends beyond the innermost part of the curled portion 16, it will flex as the easy open end 10 is moved downwardly. As will be appreciated, the easy open end 10 must have a larger diametric dimension than the upper ledge 18 so as to snap into the recess 17 and be retained thereby. The peripheral portion of the end 10, thus, is retained by the upper ledge 18.

Figure 4A:
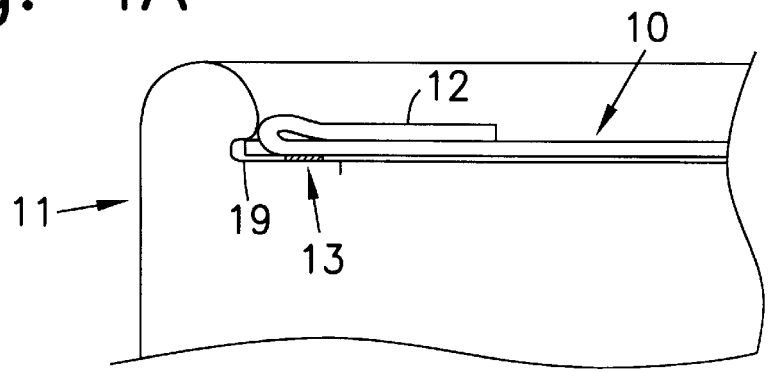
FIGS. 4A–4D show various stages in the opening of the easy open end, with FIG. 4A showing the pull tab folded down.
Figure 4B:
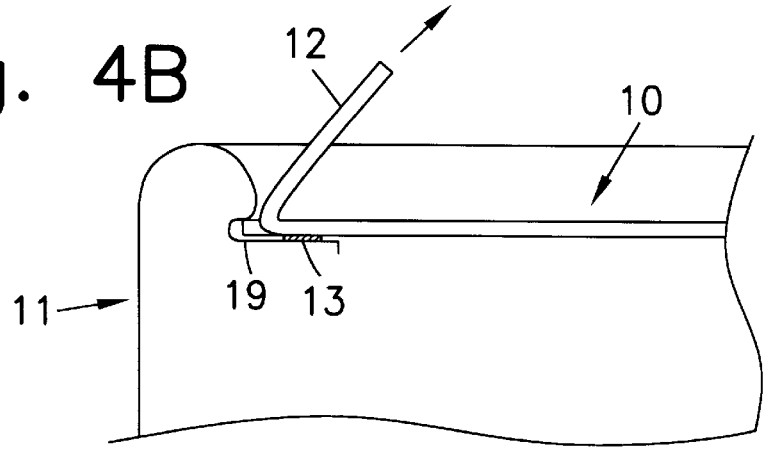
Figure 4C:
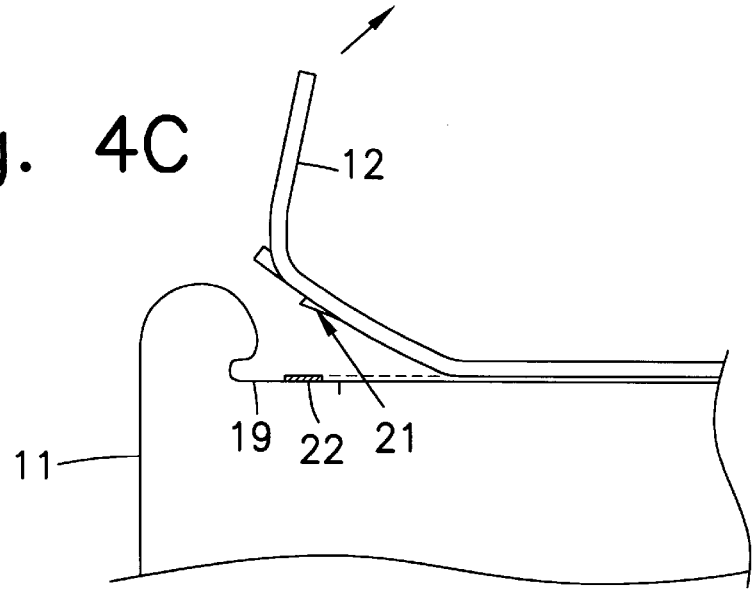
Figure 4D:
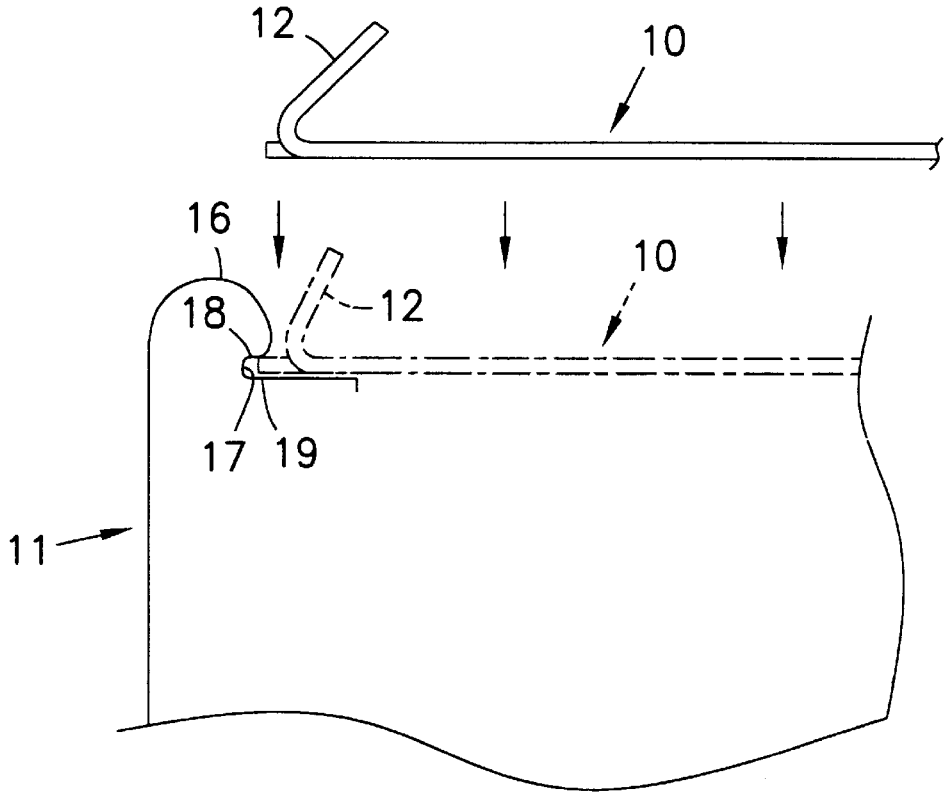

After sealing, the sealing head 14 is removed, leaving the easy open end 10 sealed to the can 11, as shown in FIG. 4A. To unseal the easy open end 10, as shown in FIG. 4B, the tab is moved from its down position upwardly. Then, as shown in FIG. 4C, a force is exerted to the tab 12 which causes the adhesive 21 on the easy open end 10 to peel away from the adhesive 22 on the lower ledge 19. Finally, as shown in FIG. 4D, the easy open end 10 is removed from the can 11.

To reseal the can 11, the easy open end 10 is simply pushed downwardly until the periphery of the easy open end 10 snaps into the recess 17.

Figure 5A:
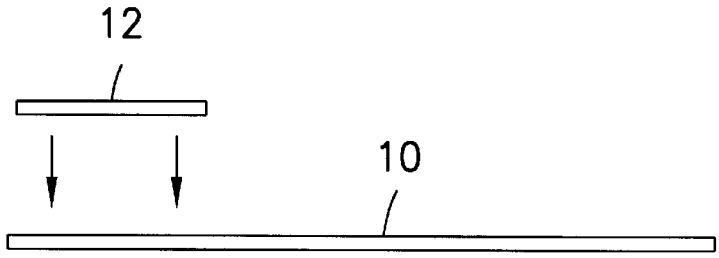
FIG. 5A shows the pull tab and easy open end in an edge view before attachment of the pull tab to the easy open end.
Figure 5B:
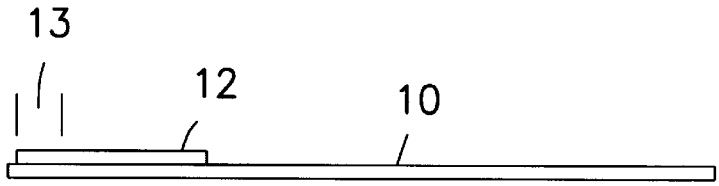
FIG. 5B is an edge view after attachment.
Figure 5C:
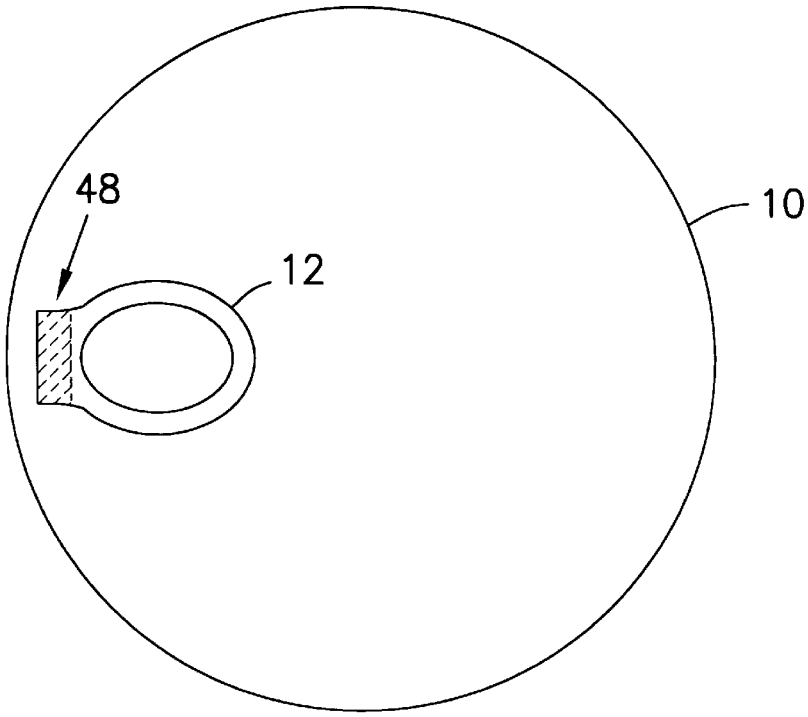
FIG. 5C is a top view after attachment.

The pull tab 12 and the easy open end 10 can be formed of two separate parts. This is shown in more detail in FIGS. 5A–5C, with FIG. 5A showing the pull tab 12 before its attachment to the easy open end 10; FIG. 5B showing the pull tab 12 after its attachment; and FIG. 5C being a top view, showing the tab attachment sealing area 48 in dashed lines.

Figure 6A:
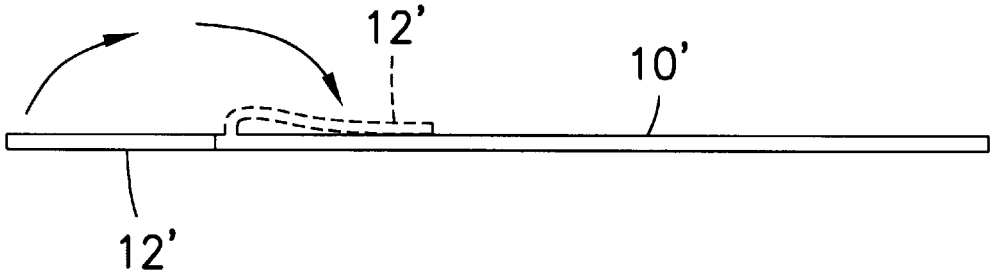
FIGS. 6A and 6B show the tab flat and folded over in an edge view and a top view, respectively, for a one-piece tab/easy open end in accordance with the invention.
Figure 6B:
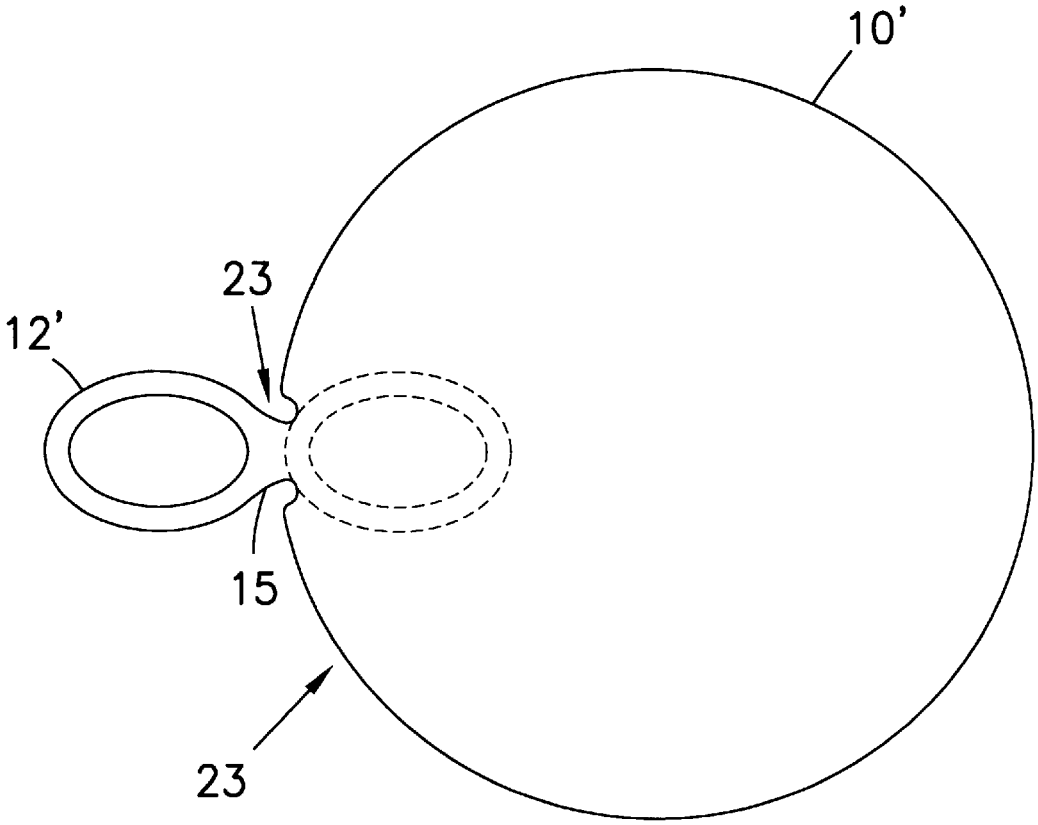

A one part easy open end/pull tab is shown in FIGS. 6A and 6B in which an easy open end 10' and a pull tab 12' are formed in one piece by an operation, such as stamping or injection molding. It is necessary to form notches 23 where the leg portion 15 of the pull tab 12' intersects with the easy open end 10' so that when the pull tab 12' is folded over (as shown in FIG. 6B by the dashed lines) it may be folded over inwardly of the periphery of the end 10'. As discussed above, this prevents the pull tab 12' and the curl 16 (FIG. 3B) on the can 11 from interfering with one another when the easy open end 10' is snapped into the can 11.

The can 11 and easy open end 10 (or 10') are designed for use where complete access is desired to the contents of the can 11. In other words, the can 11 is designed so that the end 10 or 10' comes completely off.

For beverage type cans, on the other hand, it is desired that only a small opening be made in the end which will enable beverages to be either directly poured from the can or drunk directly therefrom.

Figure 8:
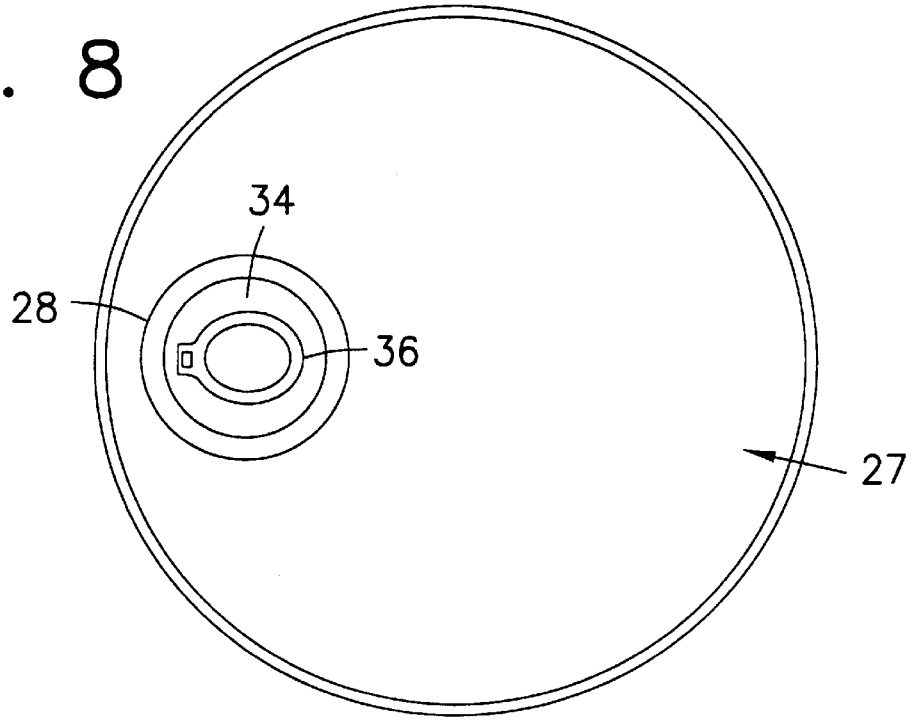
FIG. 8 is a top view of the beverage type easy open end of FIGS. 7A and 7B.
Figure 7A:
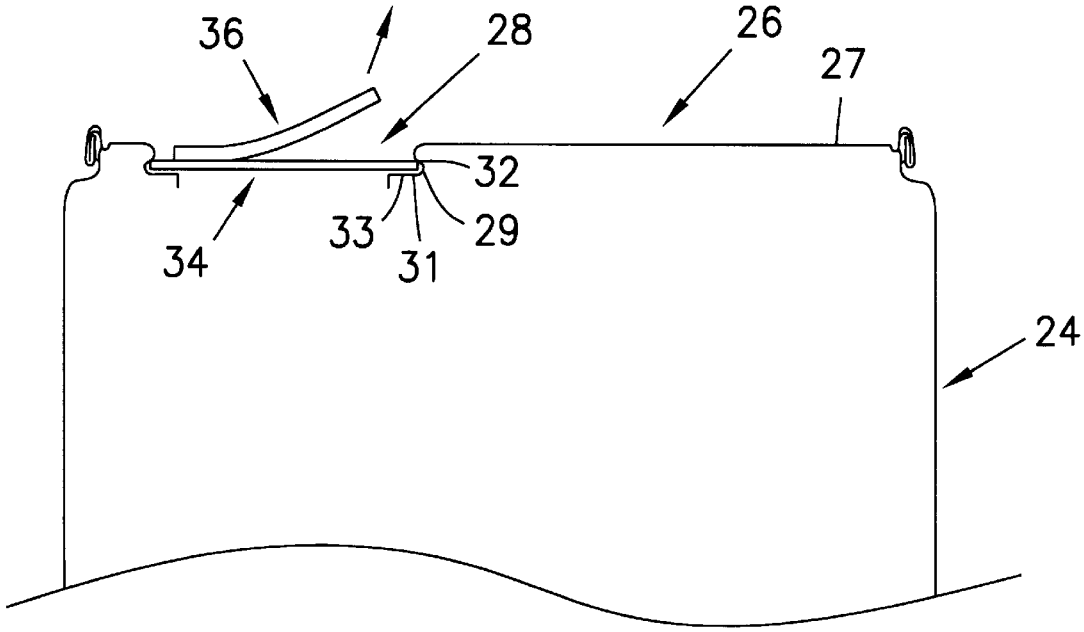
FIGS. 7A and 7B are elevation views of a beverage type easy open end in accordance with the invention, with FIG. 7A showing the easy open end below the plane of the rim of the can and FIG. 7B showing the end above the plane of the rim of the can.
Figure 7B:
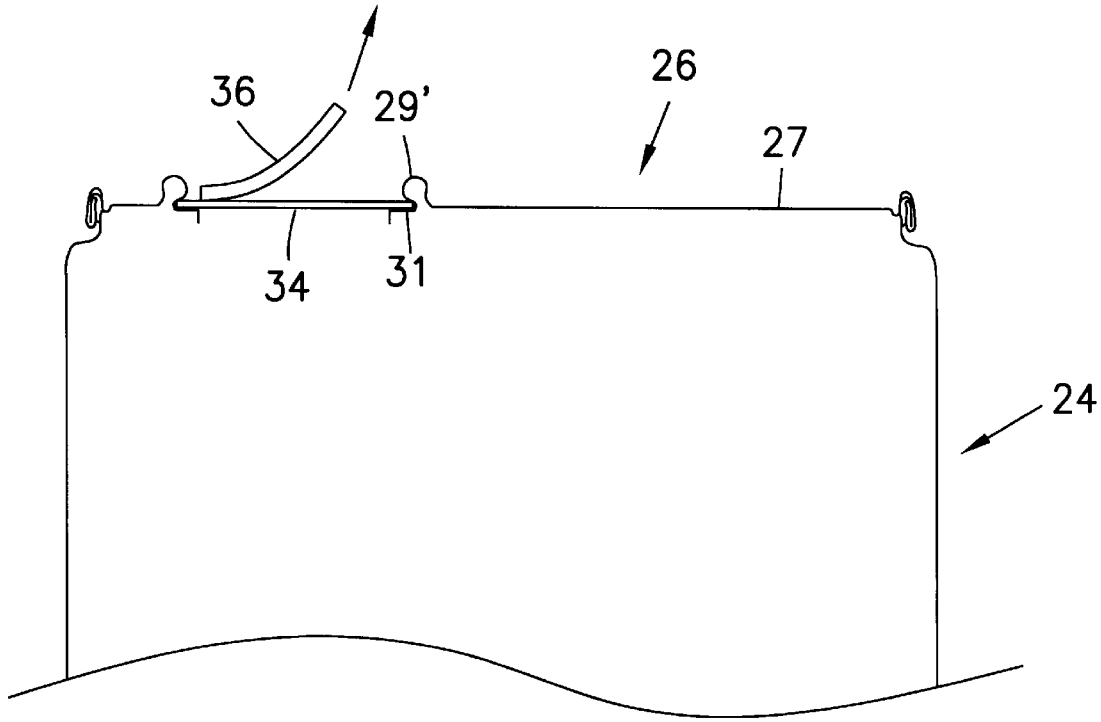

Easy open ends for beverage cans, in accordance with the present invention, are shown in FIGS. 7A, 7B and 8. More specifically, FIGS. 7A and 8 show a beverage type can 24 and top 26 having a fixed end portion 27 with a relatively small opening 28. Around the opening 28 are a curled portion 29, a recess 31 and ledges 32 and 33 similar to the curled portion 16, recess 17 and ledges 18 and 19 of FIGS. 3A and 3B. An easy open end 34 having a pull tab 36 is arranged to snap into and out of the recess 31 and be sealed to the lower ledge 33 in a manner similar to that shown in FIGS. 3A and 3B.

FIG. 7B shows a variation having a curled portion 29' which is formed above the surface of the fixed end portion 27, rather than below as in FIG. 7A. In all other respects, this embodiment is the same as the embodiment of FIG. 7A.

In operation, the pull tab 36 is pulled to pull the easy open end 34 out of the opening 28 with the remainder of the top of the can being fixed. To reseal the can, the easy open end 34 is simply pushed in so that it snaps into the recess in the curled portion.

Another embodiment of the invention having a full open resealable easy open end is shown in FIGS. 9A and 9B and FIGS. 10A and 10B.

Figure 9A:
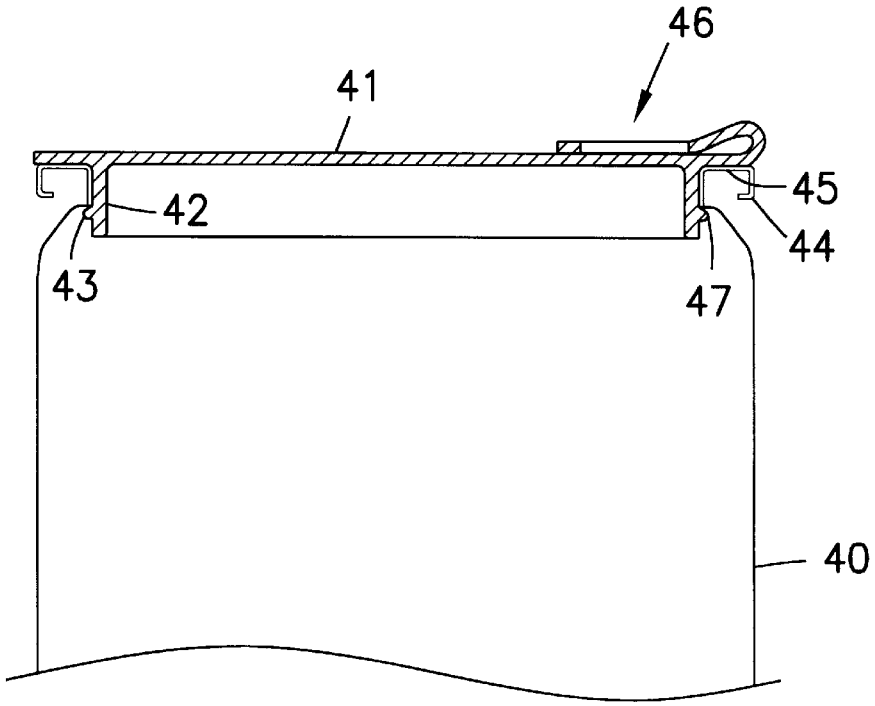
FIGS. 9A and 9B show elevation and top views, respectively, of an alternative embodiment using an external seal area and snap-in and out annular collar with detent rings and an internal can ledge.
Figure 9B:
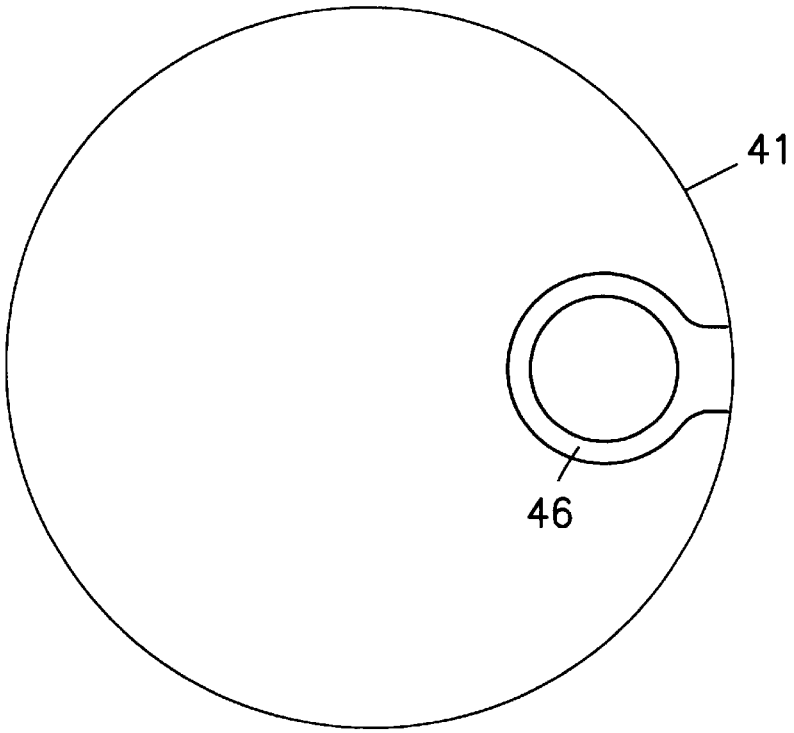
Figure 10A:
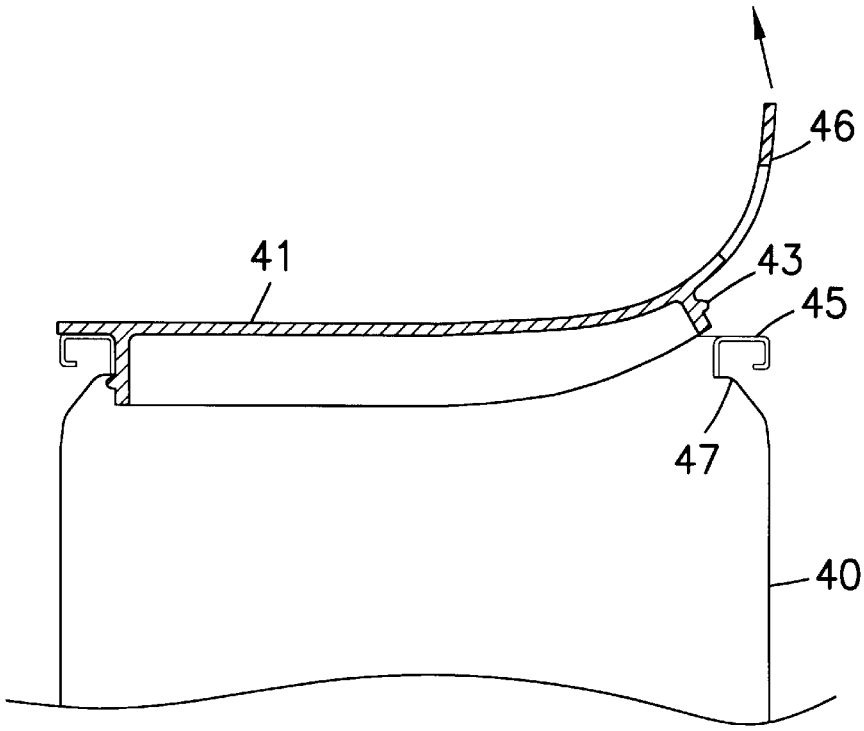
FIGS. 10A and 10B show elevation and top views, respectively, of the embodiments of FIGS. 9A and 9B with the pull tab in its up position and the seal starting to pull away.
Figure 10B:
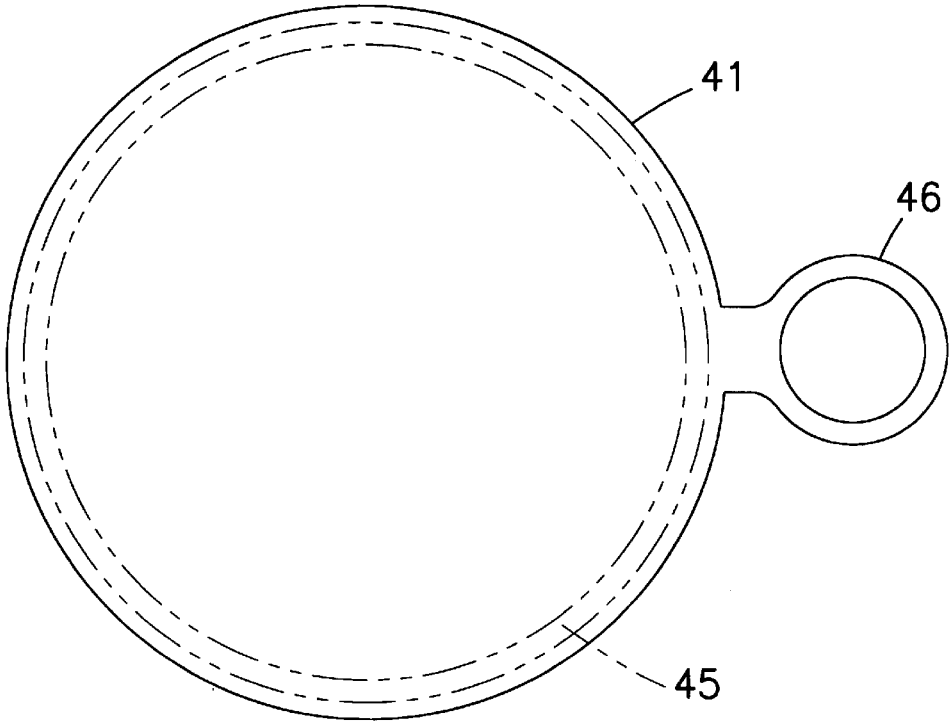

Turning first to FIGS. 9A and 9B, there is shown a can 40 and an easy open end 41 having a depending annular collar 42 with a small projection or detent ring 43 extending outwardly therefrom. The top of the can 40 instead of being curled inwardly is curled outwardly to form a curled portion 44 which is shaped to form a flat sealing surface 45. The easy open end 41 may be advantageously made by vacuum forming or by injection molding so that an integral pull tab 46 is formed. In this case, however, since the tab 46 does not enter the can 40, the tab 46 need not be formed inward of the periphery of the end 41 and, accordingly, no notches are necessary. As will be appreciated, instead of the integral pull tab 46, a two part end (not shown) may also be employed. As was the case with the other embodiments, a sealing adhesive (not shown) can be applied to both the under side of the easy open end 41 and the sealing surface 45 of the outwardly turned curl. To remove the end 41, the pull tab 46 is pulled in an upward direction, as shown in FIGS. 10A and 10B, causing the detent ring 43 to move past an annular restraining ledge 47 formed by the curled portion 44 and extending inwardly therefrom. To reseal, the end 41 is simply snapped back in.

The term "can" as used herein and in the appended claims means any receptacle, such as a metal can, a plastic container, a glass container or any similar object with which it is desired to use a resealable easy open end.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. In combination, a can and an easy openable resealable closure for said can, said can comprising a hollow body closed at a first end and an integral annular restraining ledge adjacent to an opposite second end closed by said closure and an integral annular sealing ledge spaced below said restraining ledge;

said closure comprising a detent portion and a sealing portion, said detent portion structured and arranged to fit beneath said restraining ledge and said sealing portion being so structured and arranged that it may be hermetically, peelably sealed to said sealing ledge at the same time said detent fits beneath said restraining ledge, said closure being sufficiently flexible so that it may be peeled off said sealing portion and moved from beneath the restraining ledge and thereby be removed from the can and then snapped back into non-hermetic sealing re-engagement with the sealing and restraining ledges to reseal the closure to the can; and a pull tab on said closure for pulling the closure.

2. The combination of a can and easy open resealable closure according to claim 1, further including sealing means on a portion of said closure facing said sealing ledge.

3. The combination of a can and easy open resealable closure according to claim 1, further including sealing means on at least one of a portion of said closure facing said sealing ledge.

4. The combination of a can and easy open resealable closure according to claim 3, wherein said sealing means is a sealing adhesive.

5. The combination of a can and easy open resealable closure according to claim 1, wherein the can has a flat external ledge extending externally from the second end and the closure has a peripheral portion designed to engage said external ledge.

6. The combination of a can and easy open resealable closure according to claim 5, wherein said closure includes a depending annular collar positioned inwardly of said external ledge and said detent portion is located on said collar.

7. The combination of a can and easy open resealable closure according to claim 1, wherein said can includes an integral curled portion at the second end formed inwardly thereof, said curled portion having an annular recess defining said internal annular restraining ledge.

8. The combination of a can and easy open resealable closure according to claim 7, wherein said closure and said can have common longitudinal axes and the distance between said tab and the longitudinal axis of said closure is smaller than the distance between the closest point of said curled portion to the longitudinal axis of said can and said longitudinal axis of said can.

9. The combination of a can and easy open resealable closure according to claim 8, wherein said tab and said closure comprise a one-piece part, said tab having a leg portion extending from said closure, said closure having notches extending inwardly from a periphery of said closure adjacent to said leg portion, so that said leg portion may be folded on said closure with said leg portion being located inwardly of the periphery of said closure.

10. The combination of a can and easy open resealable closure according to claim 1, wherein said closure includes a fixed end attached to said second end, said fixed end having an opening therein and said annular restraining ledge being attached to said fixed end along the periphery of said opening.

11. The combination of a can and easy open resealable closure according to claim 10, wherein said restraining ledge is located above the surface of said fixed end.

12. The combination of a can and easy open resealable closure according to claim 10, wherein said restraining ledge is located below the surface of said fixed end.

13. The combination of a can and easy open resealable closure according to claim 12, wherein said fixed end includes a curled portion formed inwardly along the periphery of said curled portion, said curled portion having an annular recess defining said internal annular restraining ledge.

14. In combination, a can and an easy openable resealable closure for said can, said can comprising a hollow body closed at a first end and an internal annular restraining ledge adjacent to an opposite second end closed by said closure;

said closure comprising a detent portion structured and arranged to fit beneath said restraining ledge, said closure being sufficiently flexible so that it may be pulled from beneath the restraining ledge and thereby be removed from the can and then snapped back into re-engagement with the restraining ledge to reseal the closure to the can;

a pull tab on said closure for pulling the closure;

said can further having a flat external ledge extending externally from the second end and the closure has a peripheral portion designed to engage said external ledge;

said closure further including a depending annular collar positioned inwardly of said external ledge and said detent portion being located on said collar; and sealing means on at least one of said peripheral portion and said external ledge.

15. In combination, a can and an easy openable resealable closure for said can, said can comprising a hollow body closed at a first end and an internal annular restraining ledge adjacent to an opposite second end closed by said closure;

said closure comprising a detent portion structured and arranged to fit beneath said restraining ledge, said closure being sufficiently flexible so that it may be pulled from beneath the restraining ledge and thereby be removed from the can and then snapped back into re-engagement with the restraining ledge to reseal the closure to the can;

a pull tab on said closure for pulling the closure;

said can further having a flat external ledge extending externally from the second end and the closure has a peripheral portion designed to engage said external ledge;

said closure further including a depending annular collar positioned inwardly of said external ledge and said detent portion being located on said collar; and sealing means on said peripheral portion and said external ledge.

16. The combination of a can and easy open resealable closure according to claim 15, wherein said sealing means is a sealing adhesive.

17. The combination of a can and easy open resealable closure according to claim 16, wherein said pull tab and said closure comprise a one-piece part formed by vacuum forming or injection molding.

18. In combination, a can and an easy openable resealable closure for said can, said can comprising a hollow body closed at a first end and an internal annular restraining ledge adjacent to an opposite second end closed by said closure;

said closure comprising:

a detent portion structured and arranged to fit beneath said restraining ledge, said closure being sufficiently flexible so that it may be pulled from beneath the restraining ledge and thereby be removed from the can and then snapped back into re-engagement with the restraining ledge to reseal the closure to the can;

a fixed end attached to said second end, said fixed end having an opening therein, said annular restraining ledge being attached to said fixed end along the periphery of said opening, said fixed end including a curled portion formed inwardly along the periphery of said curled portion, said curled portion having an annular recess defining said internal annular restraining ledge;

said restraining ledge being located below the surface of said fixed end;

said annular recess having an annular sealing ledge spaced from and opposite to said internal annular restraining ledge and said detent portion of said closure being structured and arranged to enter said recess between said annular restraining ledge and said annular sealing ledge; and a pull tab on said closure for pulling the closure.

19. The combination of a can and easy open resealable closure according to claim 18, further including sealing means on at least one of a portion of said closure facing said sealing ledge and said sealing ledge.

20. The combination of a can and easy open resealable closure according to claim 18, further including sealing means on a portion of said closure facing said sealing ledge and said sealing ledge.

21. The combination of a can and easy open resealable closure according to claim 18, wherein said sealing means is a sealing adhesive.

22. In combination, a can and an easy open resealable closure for said can, said can comprising:

a hollow body closed at one end;

an integral rim at an opposite end;

an integral curled element formed on said rim, said curled element having a convexedly curved surface facing inwardly of the rim and disposed below the top surface thereof, said curved surface halving an annular recess therein defined by spaced restraining and sealing ledges; and said resealable closure comprising:

an end member having a peripheral edge shaped to enter the recess and be retained thereby, the end member being hermetically, peelably sealable to the sealing ledge such that said end member may be released therefrom by peeling movement in a first direction and re-engaged therewith by movement in an opposite direction, the end member being sufficiently flexible such that (i) as the end member moves away from the rim, the end member flexes to decrease an effective diameter thereof, thereby moving the peripheral portion out of the recess and out of engagement with the curled element to thereby unseal the container and allow access to the inside thereof and (ii) as the end member moves back towards the rim to reseal the container, the peripheral edge of the end member is bent by the convex surface of the chime to reduce the effective diameter thereof to allow the peripheral edge to move over the convex surface of the curled element and into the recess thereof to reseal the container; and a pull tab for moving the closure in the first direction.

23. The combination of a can and easy open resealable closure according to claim 22, wherein said end member and said can have common longitudinal axes and the distance between said tab and the longitudinal axis of said end member is smaller than the distance between the closest point of the convex surface of said curled portion to the longitudinal axis of said can and said longitudinal axis of said can.

24. The combination of a can and easy open resealable closure according to claim 23, wherein said tab and said closure comprise a one-piece part, said tab having a leg portion extending from said closure, said closure having notches extending inwardly from a periphery of said closure adjacent to said leg portion, so that said leg portion may be folded on said closure with said leg portion being located inwardly of the periphery of said closure.

* * * * *